US005117740A

United States Patent [19]

Göttling et al.

[11] Patent Number: 5,117,740

[45] Date of Patent: Jun. 2, 1992

[54] APPARATUS FOR THE THREADING OUT AND IN OF AN ELASTIC COVER STRAP IN A CYLINDER WITHOUT A PISTON ROD

[75] Inventors: Helmut Göttling, Isernhagen; Rudolf Möller; Gerhard Scharnowski, both of Gehrden; Norbert Fartmann, Hanover; Hans F. Meyer, Gehrden, all of Fed. Rep. of Germany

[73] Assignee: Mannesmann Aktiengesellschaft, Dusseldorf, Fed. Rep. of Germany

[21] Appl. No.: 703,921

[22] Filed: May 22, 1991

[30] Foreign Application Priority Data

May 23, 1990 [DE] Fed. Rep. of Germany ..... 4016567

[51] Int. Cl.[5] ..... F01B 29/00

[52] U.S. Cl. ..... 92/88

[58] Field of Search ..... 92/88; 277/DIG. 7; 244/63

[56] References Cited

U.S. PATENT DOCUMENTS

| | | | |
|---|---|---|---|
| 4,373,427 | 2/1983 | Garlapaty et al. | 92/88 |
| 4,620,474 | 11/1986 | Eberle | 92/88 |
| 4,664,019 | 5/1987 | Lipinski et al. | 92/88 |
| 4,829,881 | 5/1989 | Taki et al. | 92/88 |

*Primary Examiner*—Edward K. Look
*Assistant Examiner*—F. Daniel Lopez
*Attorney, Agent, or Firm*—Cohen, Pontani, Lieberman & Pavane

[57] ABSTRACT

An apparatus for the threading-in and threading-out of an elastic cover strap in a working cylinder without a piston rod, includes an elongated tubular member (1) having a longitudinal axis; a carriage (21) having a longitudinal axis parallel to the longitudinal axis of the tubular member (1) and mounted on the tubular member for guided movement along the longitudinal axis of the carriage; the tubular member having an elongated recess (7) therein extending along the longitudinal axis of the tubular member, the recess being defined by oppositely facing sides of the tubular member each side having a length defined along the longitudinal axis of the tubular member and a depression (32,33) along the length; an elongated cover strap (8) for covering the recess, the strap having a longitudinal axis, a transverse axis in the plane of the strap, and longitudinal edges sized for mating engagement with the depressions defined in the oppositely facing side walls of the recess (7), and an upper flat surface facing toward the carriage (21) and a lower flat surface facing the recess (7); and a pair of opposed inclined surfaces at the end portions of the carriage extending obliquely to the longitudinal axis of the cover strap and obliquely to the transverse axis of the cover strap in the plane of the cover strap.

11 Claims, 2 Drawing Sheets

APPARATUS FOR THE THREADING OUT AND IN OF AN ELASTIC COVER STRAP IN A CYLINDER WITHOUT A PISTON ROD

FIELD OF THE INVENTION

The present invention relates to an apparatus for the threading out and in of an elastic cover strap which covers a recess, particularly for a working cylinder without a piston rod.

BACKGROUND OF THE INVENTION

A working cylinder without a piston rod is known from Federal Republic of Germany OS 38 07 786 which also refers to U.S. Pat. Nos. 4,664,020 and 4,545,290.

The known device of OS 38 07 786 is provided on a carriage of a working cylinder which serves as the driven part. The carriage is mounted for displacement in a guide arranged in the longitudinal direction of the working cylinder which is formed by a profiled-section pipe. The carriage is further connected via a driver element with a piston which serves as a driving part and which is displaceably or movably arranged and sealed off within the profiled-section pipe.

A part of the carriage which faces the profiled-section pipe extends into a recess extending in the longitudinal direction of the profiled-section pipe, the carriage moving parallel to said recess. The recess is covered by a cover strap. The cover strap is held in a mount which consists of undercuts or grooves which are provided in the lateral walls which define the recess.

In order to be able to thread the cover strap which passes through the carriage out of the recess and to thread the strap again into the recess upon movement of the carriage in the direction of the longitudinal axis of the cylinder, the carriage is provided, in the region of the ends of the part attached to the carriage and in front of and behind the region into which the part attached to the carriage extends into the recess, with inclines for the threading out and in of the cover strap located on the sides of the cover strap facing away from each other, with the inclines extending obliquely to the longitudinal axis of the cover strap, and seen in the direction of the longitudinal axis of the cover strap.

Upon movement of the carriage in the direction of the longitudinal axis of the cylinder, the cover strap is forced out of the recess by the incline serving as a threading-out device which is placed into the side of the cover strap facing the recess. In this process, the projections of the cover strap which are located in the undercuts are pulled out of the undercuts.

The reintroduction of the cover strap is effected by means of the incline serving as a threading-in device which lies on the cover strap on the side thereof facing away from the recess and forces the projections of the cover strap into the undercuts in the walls defining the recess.

This working cylinder has the disadvantage that both upon the threading of the cover strap out of the recess and upon the threading thereof into the recess relatively large forces of deformation occur on the cover strap and furthermore relatively large frictional forces also occur between the projections of the cover strap and the walls defining the undercuts causing a considerable amount of wear on the projections of the cover strap.

Furthermore, the cover strap must consist of a material which is of relatively high elasticity.

SUMMARY OF THE INVENTION

It is an object of the invention to provide an apparatus of the aforementioned type for easily threading the cover straps out of and into the recess while avoiding large frictional and deforming forces.

This object is achieved by providing an apparatus for the threading-in and threading-out of an elastic cover strap in a working cylinder without a piston rod, said apparatus comprising:

an elongated tubular member having a longitudinal axis and an elongated recess therein defined by opposed side walls and extending along said longitudinal axis, each said side wall comprising a depression extending along said longitudinal axis thereof;

a carriage having oppositely located end portions and being mounted on said tubular member above said recess for movement along said axis;

a cover strap for covering said recess, said strap having longitudinally extending opposed side edges for mating engagement with said depressions, a longitudinal axis and a transverse axis in the plane of said strap; and means at said carriage for threading said strap into said recess and means for threading said strap out of said recess; said threading-in and threading-out means comprising opposed inclined surfaces at said end portions extending obliquely to said longitudinal axis of said cover strap and obliquely to said transverse axis of said cover strap in said plane of said cover strap. In a preferred embodiment, the inclines at the end portions of the carriage extend in curved fashion obliquely to the transverse axis of the cover strap in the plane of the cover strap.

The invention affords the advantage, in particular, that upon the threading-out, one of the parallel extending sides of the cover strap can first be lifted out of one of the two undercuts or grooves, and then the other side of the cover strap can be removed without the expenditure of force from the other undercut while upon the threading-in the one side of the cover strap can be introduced without the use of force into the one undercut, and then the second side of the cover strap can be pressed, with the expenditure of only a slight force, into the other undercut.

BRIEF DESCRIPTION OF THE DRAWINGS

One embodiment of the present invention will be described in further detail below with reference to the drawings in which.

DETAILED DESCRIPTION OF THE PRESENTLY PREFERRED EMBODIMENT

Figure 1:
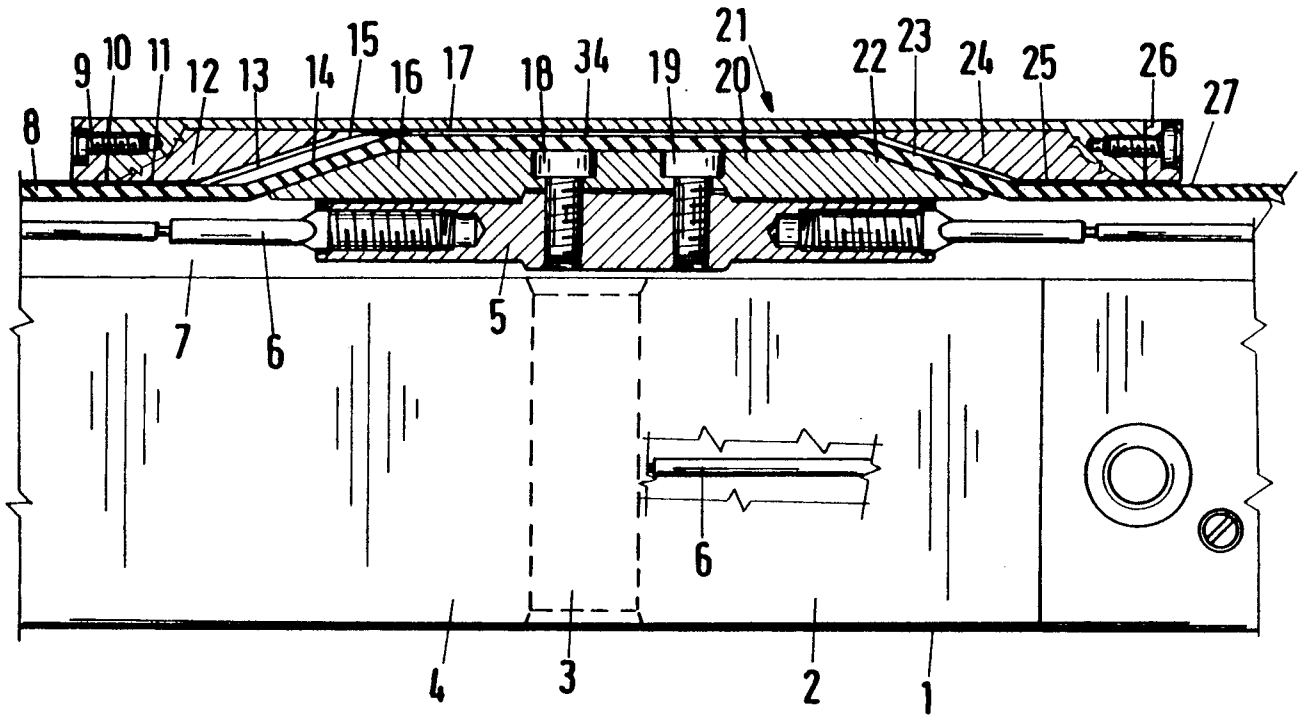
FIG. 1 is a fractional cross-sectional view of a working cylinder without a piston rod having a carriage which is attached to a piston by means of a pull member.

FIG. 1 shows a portion of a working cylinder which has a tubular body developed as profiled-section pipe 1, and in which a piston 3 which serves as a driving element is displaceably arranged in a sealed-off manner.

The piston 3 divides the cylinder into a first working chamber 2 and into a second working chamber 4 located opposite the first working chamber 2 on the other side of the piston 3.

The profiled-section pipe 1 has, extending in the direction of its longitudinal axis, a guide for a carriage 21 which is mounted in the guide for displacement in the direction of the longitudinal axis of the profiled-section pipe 1.

The carriage 21 is connected to the piston 3 via a driver element, developed as a pull member 6, which is conducted over reversal elements (not shown) arranged at the ends of the cylinder. The piston 3 and the pull member 6 form in this embodiment the drive element 3, 6 for the carriage 21. The pull element 6 extends in the region of the guide in a recess 7 which is arranged in the longitudinal direction of the cylinder in the profiled-section pipe 1. In other words, the carriage 21 is guided parallel to the recess 7.

In the walls of the profiled-section pipe 1 which define the sides of the recess 7, there are depressions formed by undercuts 32,33 (FIG. 2), which depressions are arranged opposite each other and are tapered towards their bottom.

Undercuts 32,33 serve as support for an elastic strap 8 developed, for instance, as a flat-strap body which serves to cover the recess 7 which receives the pull element or pull member 6. The cover strap 8 has bevels on its outer edges which extend parallel to each other, the bevels corresponding to the bevels of the undercuts and representing substantially the positive form of said undercuts.

The cover strap 8 is passed through the carriage 21 in its longitudinal direction.

The carriage 21 is attached to a part 5 which serves as a drive part and is also connected to the pull element 6 and extends past the cover strap 8 into the recess 7.

The drive part can also be attached directly to the piston 3 via the carriage 21. In such case, pull member 6 and reversal parts (not shown) are unnecessary.

The carriage 21 thus consists substantially of an outer part 17 having a threading-in device 11, 12, 13 or 23, 24, 25 for the cover strap 8 and an inner part 16, 5 having a threading-out device 14, 22, 16 for the cover strap 8. The cover strap 8 extends in a slot 15 which is defined by the outer part 17 with threading-in device 11, 12, 13, 23, 24, 25 and the inner part 16, 5 with threading-out device 14, 22, 16.

The threading-out device 14, 22, 16 is screwed on the side thereof facing away from the cover strap 8 to the part 5 of the inner part 5, 16 by means of screws 18 and 19. On each of the end sides of the outer part 17 facing away from each other there is provided a closure plate 9 and 26 respectively which plates are connected to the outer part 17 by screws. In both plates 9 and 26, slots 10 and 27 are provided for the passage of the pull member 6 and of the cover strap 8.

The part 14, 22, 16 of the inner part 5, 16 of the carriage 21 which serves as threading-out device is provided on each of its end regions facing away from each other with an incline 14 and 22 respectively. Each of the two inclines 14 and 22 tapers, starting from the side 20 of the part 16 of the carriage 21 facing the outer part 17 in the direction of the longitudinal axis of the inner part 16, 5 towards its free end region, in a direction towards the bottom of the recess 7.

The outer part 17 of the carriage 21 is also provided on its side facing the inner part 16, 5 of the carriage 21 on its end regions facing away from each other with, in each case, an incline 13 and 23 respectively, serving as a threading-in device, these inclines 13 and 23 extending substantially parallel to the corresponding opposite inclines 14 and 22 of the part 16 of the inner part 16, 5 of the carriage 21.

Adjoining the ends of the inclines 13 and 23 of the outer part 17, there are horizontally extending surfaces 11 and 25 respectively which are part of the threading-in device.

The part 16 of the inner part 16, 5 has, on its side facing the horizontally extending region of the outer part 17, also a horizontal surface 20 which is adjoined by the inclines 14 and 22.

The carriage 21 thus has, in the region of the ends of the part 5 connected to the carriage 22 or in front of and behind the region in which the part 5 extends into the recess 7, in each case, two inclines 14, 22 and 13, 23 respectively on the sides of the cover strap 8 facing away from each other for the threading-out and threading-in respectively of the cover strap 8, these inclines 14, 22 and 13, 23 extending obliquely to the longitudinal axis of the cover strap 8 (as seen in the direction of the longitudinal axis of the cover strap 8).

In addition, the inclines 14, 22 and 13, 23 extend obliquely to an imaginary transverse axis of the cover strap 8 in the plane of the cover strap 8.

As already mentioned, the cover strap 8 is guided in slot 15 defined by the horizontal surfaces 17 and 20 and inclines 13, 23 and 14, 22 respectively. The cover strap 8 also rests against the horizontal surface 20 and against the inclines 14 and 22 of the part 16 of the inner part 16, 5 of the carriage 21.

The threading-out device 16, 14, 22 provided on the part 16 of the inner part 16, 5 of the carriage 21 is provided at its end regions facing away from each other with an additional incline which extends obliquely to an imaginary longitudinal axis of the cover strap 8 in the plane of the cover strap 8.

Similarly, the threading-in device 12, 13, 23, 24 has at each of its end regions facing away from each other an additional incline which extends obliquely to a longitudinal axis of the cover strap 8 in the plane of the cover strap 8.

The threading-in device 12, 13, 24, 23 is developed substantially as a negative form of the threading-out device 14, 16, 22.

Figure 2:
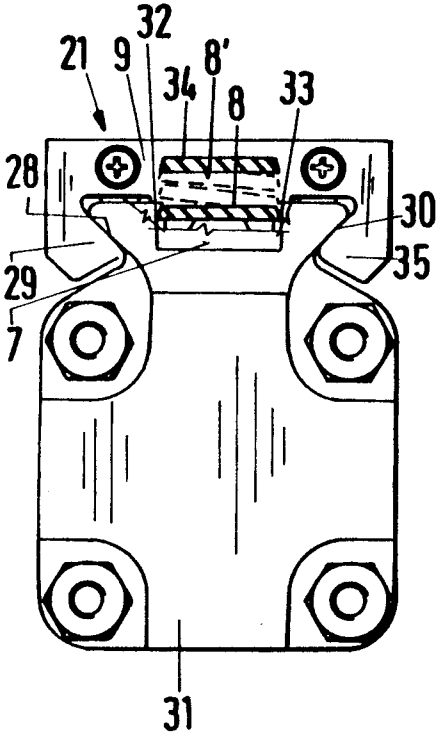
FIG. 2 is the end view of the working cylinder of FIG. 1.

An end side 31 of the working cylinder of FIG. 1 is shown in FIG. 2.

For greater clarity, structural parts identical to those shown in FIG. 1 have been provided with the same reference numerals.

The cylinder housing which is developed as a profiled-section pipe has a dovetail-shaped guide 28, 30 into the depressions of which angularly bent projections 29 and 35 of the carriage 21 engage. The guide 28, 30 for the carriage 21 has a centrally arranged recess 7 extending in the direction of the longitudinal axis of the guide 28, 30, the pull element 6 extending within said recess.

The recess 7 is covered by the cover strap 8 which is held in a mount.

The mount for the cover strap 8 consists of two depressions or undercuts 32 and 33 which are arranged opposite each other in the walls laterally defining the recess 7. The depressions or undercuts 32 and 33 taper towards the bottom of the undercuts 32 and 33 respectively. The parallel extending sides of the cover strap 8 which face away from each other have substantially the same shape as the undercuts 32 and 33 (but a positive form in contradistinction to the negative form of the undercuts). The cover strap 8 is guided within the carriage 21 over the part 16, developed as a threading-out device, of the inner part 16, 5 of the carriage 21 (see FIG. 1). The side of the outer part 17 of the carriage 21 which is developed as a threading-in device and extends horizontally facing the cover strap 8 is designated by the reference numeral 34.

Figure 3:
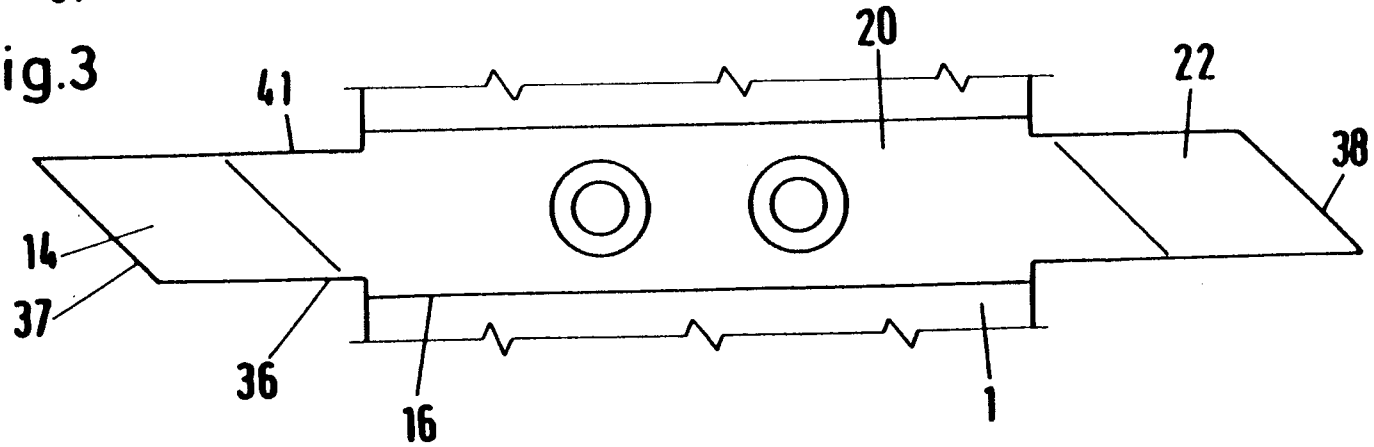
FIG. 3 is a top view of the part of the carriage forming the threading-out device.

FIG. 3 is a top view of the guide for the carriage 21 of the working cylinder having the inner part 16, 5 of the carriage 21 provided with the threading-out device. For greater clarity the parts identical to parts shown in FIGS. 1 and 2 have been provided with the same reference numerals.

The inner parts 16, 5 of the carriage 21 which serve as a threading-out device for the cover strap are arranged for displacement in the direction of the longitudinal axis of the guide within the recess of the guide of the profiled-section pipe 1.

The part 16 is developed as a plate-like member with two side surfaces 41 and 36 extending in the longitudinal direction of the recess, parallel to each other.

The end sides 37 and 38 of the part 14, 16, 22 which face away from each other extend in the plane of the cover strap 8 obliquely to the longitudinal axis of the part 14, 16, 22, with the end sides 37 and 38 also extending substantially parallel to each other.

The angle between the first side surface 41 and the first end side 37 is preferably equal to the angle diagonally opposite it between the second side surface 36 and the second end side 38 of the part 14, 16, 22 in the horizontal plane (plane of the cover strap 8).

Similarly, the angle between the second side surface 36 and the first end surface 37 is preferably equal to the angle diagonally opposite it between the first side surface 41 and the second end side 38 of the part 14, 16, 22 in the horizontal plane (plane of the cover strap).

The first two angles which are diagonally opposite each other are preferably smaller than the second two angles which are diagonally opposite each other. In other words, the end regions of the part 14, 16, 22 taper asymmetrically in the horizontal plane. The smaller first angles and the larger second angles need not be diagonally opposite each other; they can also be formed in each case by one of the two longitudinal sides 35 and 36 and the end sides 37 and 38 facing away from each other respectively.

Each of the two end regions of the part 14, 16, 22 has both an incline lying in the horizontal plane and an incline lying in the vertical plane, as can be noted from FIGS. 1 and 3.

Figure 4:
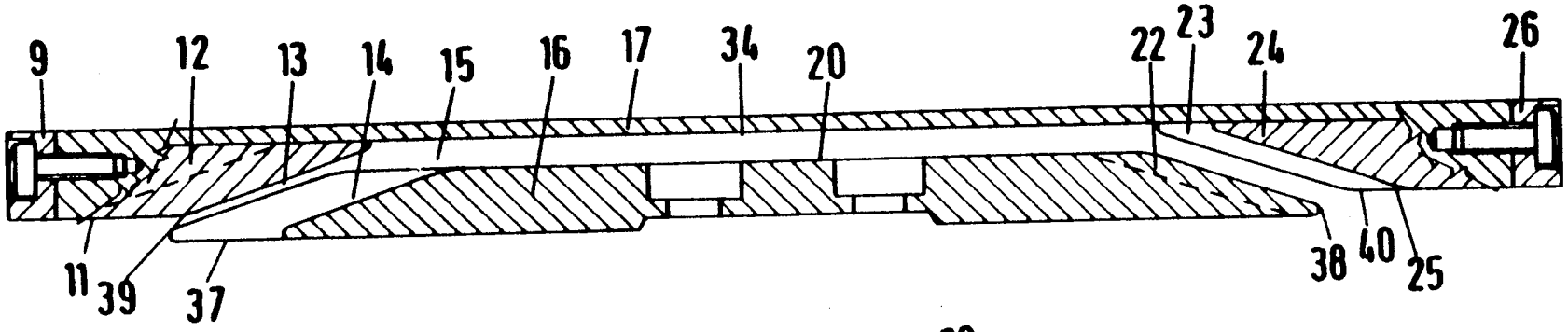
FIG. 4 is a cross-sectional view through the part of the carriage forming the threading-out device, the end regions of the threading-out device tapering asymmetrically in the direction of the longitudinal axis of the threading-out device, as well as the threading-in device which is developed as a negative form.

In FIG. 4, the inner part 14, 16, 22 which is developed as a threading-out device and the outer part 11, 12, 13, 17, 23, 24, 25 of the carriage 21 which is developed as a threading-in device are shown. For greater simplicity, parts identical to the parts shown in FIGS. 1 to 3 are provided with the same reference numerals.

As the side view of the inner part 14, 16, 22 serving as a threading-out device shows, this part of the carriage 21 has at each of its end regions facing away from the other a bevel 14 and 22 respectively which extends in the longitudinal direction of the part 14, 16, 22 and tapers towards the corresponding end side, the end sides 37 and 38 of these bevelled end regions extending in the horizontal plane obliquely to the longitudinal axis of the part 14, 16, 22.

The outer part 11, 12, 13, 17, 23, 24, 25 developed as a threading-in device of the carriage 21 represents a negative form of the inner part 14, 16, 22 serving as a threading-out device and has, opposite the corresponding bevel 14 and 22 of the inner part 14, 16, 22, also a bevel 13 and 23 respectively extending substantially parallel to the corresponding bevel 14 and 22 respectively of the part 14, 16, 22, said bevel 13 and 23 extending in the longitudinal direction of the part 11, 12, 13, 17, 23, 24, 25.

Corresponding to the end sides 37, 38 which extend obliquely to the longitudinal axis of the inner part 14, 16, 22, the outer part 11, 12, 13, 17, 23, 24, 25 also has two edges 39 and 40 which extend obliquely to the longitudinal axis of the outer part 11, 12, 13, 17, 23, 24, 25 and are arranged extending parallel to the end sides 37 and 38 respectively of the inner part 14, 16, 22.

Adjoining these edges 39 and 40 there are the surfaces 11 and 25, extending parallel in the horizontal plane of the recess, of the threading-in device 11, 12, 13, 23, 24, 25 of the outer part 17.

The function of the threading-out device and the threading-in device of the carriage 21 will be explained in further detail below.

If the carriage 21 shown in FIG. 1 is moved for instance to the left by means of the piston 3 traveling to the right and of the pull element 6, then the one side of the cover strap 8 is pressed out of the one undercut 32 in the direction towards the slot 15 by the edge, protruding as seen in the longitudinal direction of the threading-out device 14, 16, 22, of the end side 37, side 41 defining the smaller angle, end side 37 and a part of the incline 14 of the inner part 14, 16, 22 serving as a threading-out device, as shown as 8' and in dashed line in FIG. 2. The cover strap 8 is tilted practically in the region of the incline 14 of the threading-out device 14, 16, 22 around a longitudinal axis of the cover strap 8 in the plane of the cover strap 8.

Upon the further movement of the carriage 21 in the same direction, the cover strap 8 is then lifted by the entire incline 14 of this end region of the part 14, 16, 20, 22 serving as a threading-out device out of the other undercut 33 which is opposite said undercut 32. In this connection, only very slight gliding friction is produced between the side surface of the cover strap 8 and the surface of the undercut 33.

Due to the fact that the cover strap 8 is lifted by the incline 14 of this end region of the part 14, 16, 22 serving as a threading-out device, out of the mount 32, 33 (undercuts 32, 33) of the recess 7, the carriage 21 can, via the part 5, which is attached to the carriage 21 and to which the pull element 6 is fastened be moved unimpeded in the recess 7.

The region of the recess 7 located in front of and behind the carriage 21 remains, in this connection, at all times covered by the cover strap 8. Only the part of the recess 7 located within the region of the carriage 21 is freed.

If the carriage 21 is moved back again towards the right (the piston 3 in this case moves towards the left), then the one longitudinal side of the cover strap 8 is introduced into the corresponding undercut 33 from the side of the region having the incline 13 of the outer part 11, 12, 13, 17, 23, 24, 25 serving as a threading-in device, the edge 39 of which part is further removed from the end side of this part 11, 12, 13, 17, 23, 24, 25.

Upon the further movement of the carriage 21 in the same direction, the cover strap 8 is pressed by the entire incline 13 of this end region of the part 11, 12, 13, 17, 23, 24, 25 serving as a threading-in device into the undercut 32 opposite said undercut 33.

Since both the end regions facing away from each other of the inner part 14, 16, 22 serving as a threading-out device, as well as the end regions facing away from each other of the outer part 11, 12, 13, 17, 23, 24, 25 serving as a threading-in device of the carriage 21 are developed as positive form and as corresponding negative form, the cover strap 8, upon movement of the carriage 21, is simultaneously lifted by the one end region of the carriage 21 out of its mount and introduced by the other end region of the carriage 21 facing away from said end region again into the mount 32, 33.

The end regions facing away from each other which have the inclines of the inner part 14, 16, 22 serving as a threading-out device are of identical development. Similarly, the end regions facing away from each other and having the inclines of the part 11, 12, 13, 17, 23, 24, 25 serving as a threading-in device are of identical development.

The end sides 37 and 38 of the part 14, 16, 22 serving as a threading-out device can be formed by a straight edge extending obliquely to the longitudinal axis of the threading-out device 14, 16, 22. However, they can also have a curved shape. Similarly of course, the edges 39 and 40 of the threading-in device 11, 12, 13, 23, 24, 25 which are arranged parallel to said end sides can also extend obliquely to the longitudinal axis of the threading-in device 11, 12, 13, 17, 23, 24, 25 or have a curved shape.

It is essential for the invention that the one side of an end side protrude with respect to the other side of said end side which is limited by the two side surfaces of the threading-out device 14, 16, 20, 22, in the direction of the longitudinal axis of the threading-out device 14, 16, 22.

The same is true of the edges 39 and 40 of the threading-in device 11, 12, 13, 23, 24, 25 which are arranged parallel to the end sides of the threading-out device 14, 16, 22.

This means that the threading-out device 14, 16, 22 and the threading-in device 11, 12, 13, 17, 23, 24, 25 which are attached to the carriage or developed as part of the carriage each has an asymmetric taper extending substantially in the direction of the longitudinal axis of the threading-out device 14, 16, 22 and the threading-in device 11, 12, 13, 17, 23, 24, 25 respectively and/or substantially transverse to the longitudinal axis of the threading-out device 14, 16, 22 and the threading-in device 11, 12, 13, 17, 23, 24, 25 respectively.

The inclines for the threading-out of the cover strap and the inclines for the threading-in of the cover strap extend obliquely to the longitudinal axis of the band or cover strap in the plane of the cover strap and in addition obliquely to a transverse axis of the cover strap in the plane of the cover strap.

The said inclines can of course also have a curved course obliquely to a transverse axis of the cover strap in the plane of the cover strap and/or obliquely to a longitudinal axis of the cover strap in the plane of the cover strap.

It should be understood that the preferred embodiments and examples described are for illustrative purposes only and are not to be construed as limiting the scope of the present invention which is properly delineated only in the appended claims.

What is claimed is:

1. An apparatus for the threading-out and threading-in of a cover strap for a recess in a cylinder, particularly a cylinder without a piston rod, said apparatus comprising:

an elongated tubular member (1) having a longitudinal axis;

a carriage (21) having a longitudinal axis parallel to said longitudinal axis of said tubular member (1) and being mounted on said tubular member for guided movement along said longitudinal axis of said carriage;

said tubular member having an elongated recess (7) therein extending along said longitudinal axis of said tubular member, said recess (7) being defined by oppositely facing sides of said tubular member, each said side having a length defined along said longitudinal axis of said tubular member and a depression (32,33) along said length;

said elongated cover strap (8) for covering said recess, said strap having a longitudinal axis, a transverse axis in the plane of said strap, and longitudinal edges sized for mating engagement with said depressions defined in said oppositely facing sides of said recess (7), and an upper flat surface facing toward said carriage (21) and a lower flat surface facing said recess (7);

means (3,5,6) for moving said carriage attached to said carriage and disposed at least partially within said recess;

means for threading-out said strap from said depressions (32,33) one edge at a time, and for uncovering said recess without substantially deforming said strap and substantially without friction between said edge and said depression, said threading-out means being connected to said carriage moving means for concomitant movement therewith and disposed along said lower flat surface of said strap; and means (13,23) for threading-in said strap into said depressions (32,33) one edge at a time, and for covering said recess without substantially deforming said strap and substantially without friction between said edge and said depression, said threading-in means being connected to said carriage and disposed along said upper flat surface of said strap.

2. The apparatus of claim 1, wherein said means for threading-out and said means for threading-in said strap comprise respective inclines (14,22 and 13,23) extending obliquely to said longitudinal axis of said cover strap and obliquely to said transverse axis of said cover strap in the plane of said cover strap.

3. The apparatus of claim 1, wherein said cover strap additionally comprises said longitudinal axis in the plane of said cover strap; said means for threading-in and threading-out said cover strap comprising inclines (14,22 and 13,23) extending obliquely to said longitudinal axis of said strap in the plane of said strap.

4. The apparatus of claim 3, wherein said inclines (14,22 and 13,23) extend in curved fashion obliquely to said longitudinal axis of said cover strap in the plane of said cover strap.

5. The apparatus of claim 1, wherein said means for threading-in and threading-out said cover strap comprise inclines (14,22 and 13,23) extending in curved fashion obliquely to said transverse axis of said cover strap in the plane of said strap.

6. The apparatus of claim 1, wherein said means for threading-out (14,16,22) said cover strap comprises two opposed end portions (37,38), each of said end portions (37,38) comprising an incline (14,22) pointing toward said elongated recess (7).

7. The apparatus of claim 1, wherein said means for threading-in said cover strap comprises two opposed end of portions (12,24), each said end portions comprising an incline (13,23) facing said upper surface of said strap.

8. The apparatus of claim 1, wherein said means for threading-out (14,16,22) said cover strap comprises two opposed end portions (37,38), each of said end portions (37,38) comprising an incline (14,22) pointing toward said elongated recess (7); said means for threading-in said cover strap comprises two opposed end portions (12,24), each of said end portions comprising an incline (13,23) facing said upper surface of said strap; and said incline of said means for threading-out said strap extending substantially parallel to said inclines of said means for threading-in said strap.

9. The apparatus of claim 1, wherein said means (3,5,6) for moving said carriage comprises a piston (3).

10. The apparatus of claim 1, wherein said cover strap is an elastic flat strap comprising opposed longitudinal bevelled edges for mating engagement with said depressions (32,33) within said side walls of said recess (7).

11. An apparatus for the threading-in and threading-out of an elastic cover strap in a working cylinder without a piston rod, said apparatus comprising:

an elongated tubular member having a longitudinal axis and an elongated recess therein defined by opposed side walls and extending along said longitudinal axis, each said side wall comprising a depression extending along said longitudinal axis thereof;

a carriage comprising oppositely located end portions mounted on said tubular member above said recess for movement along said axis;

said cover strap for covering said recess, said strap having longitudinally extending opposed side edges for mating engagement with said depressions, a longitudinal axis and a transverse axis in the plane of said strap; and means at said carriage for threading said strap into said recess and means for threading said strap out of said recess; said threading-in and threading-out means comprising opposed inclined surfaces at said end portions extending obliquely to said longitudinal axis of said cover strap and obliquely to said transverse axis of said cover strap in said plane of said cover strap.

* * * * *